US008942575B2

(12) United States Patent
Matsuda

(10) Patent No.: US 8,942,575 B2
(45) Date of Patent: Jan. 27, 2015

(54) IMAGE FORMING APPARATUS THAT INCLUDES A COVER OPEN/CLOSED DETECTION SENSOR

(71) Applicant: Kyocera Document Solutions Inc., Osaka (JP)

(72) Inventor: Masatomo Matsuda, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 40 days.

(21) Appl. No.: 13/784,464

(22) Filed: Mar. 4, 2013

(65) Prior Publication Data

US 2013/0243443 A1 Sep. 19, 2013

(30) Foreign Application Priority Data

Mar. 13, 2012 (JP) ..... 2012-056386

(51) Int. Cl.

| | |
|---|---|
| ***G03G 15/00*** | (2006.01) |
| ***G03G 15/20*** | (2006.01) |
| ***G03G 21/00*** | (2006.01) |
| ***G03G 21/16*** | (2006.01) |

(52) U.S. Cl.

CPC ..... *G03G 15/55* (2013.01); *G03G 21/1633* (2013.01); *G03G 21/1638* (2013.01); *G03G 21/1647* (2013.01); *G03G 15/2053* (2013.01)

USPC ..... 399/9; 399/21; 399/124

(58) Field of Classification Search

CPC ..... G03G 15/55; G03G 15/2053; G03G 21/1628; G03G 21/1633; G03G 21/1638; G03G 2215/00548

USPC ..... 399/9, 21, 110, 107, 67, 124, 125

See application file for complete search history.

(56) References Cited

U.S. PATENT DOCUMENTS

| | | | | |
|---|---|---|---|---|
| 6,078,781 | A | 6/2000 | Takagi et al. | |
| 7,792,437 | B2 * | 9/2010 | You | 399/9 |
| 2008/0124094 | A1 * | 5/2008 | Eom | 399/9 |
| 2009/0003869 | A1 | 1/2009 | Takahashi | |
| 2010/0020350 | A1 * | 1/2010 | Lee et al. | 358/1.15 |

FOREIGN PATENT DOCUMENTS

| | | |
|---|---|---|
| JP | 2001-272885 A | 10/2001 |
| JP | 2011-180188 A | 9/2011 |

OTHER PUBLICATIONS

EESR issued to EP Application No. 13158301.5, mailed Jul. 15, 2013.

* cited by examiner

*Primary Examiner* — Sophia S Chen

(74) *Attorney, Agent, or Firm* — Knobbe Martens Olson & Bear, LLP

(57) ABSTRACT

The image forming apparatus includes a cover member, a cover open/closed detection sensor, a driven unit, a drive detection sensor, and an attitude determination unit. The cover open/closed detection sensor outputs a closed signal corresponding to a closed attitude and an open signal corresponding to an open attitude. The drive detection sensor outputs a state signal corresponding to the drive state of the driven unit. The attitude determination unit determines whether the cover member is in an open attitude or is in a closed attitude based on a closed signal and a state signal input after the open signal.

7 Claims, 3 Drawing Sheets

IMAGE FORMING APPARATUS THAT INCLUDES A COVER OPEN/CLOSED DETECTION SENSOR

INCORPORATION BY REFERENCE

This application is based upon and claims the benefit of priority from the corresponding Japanese Patent Application No. 2012-056386, filed in the Japan Patent Office on Mar. 13, 2012, the entire contents of which are incorporated herein by reference.

BACKGROUND

This disclosure relates to an image forming apparatus that includes a driven unit provided in an inner portion of a housing and a cover member configured to open and close an opening formed in the housing, and in particular, relates to an image forming apparatus that includes a cover open/closed detection sensor configured to detect an open/closed state of a cover member.

A conventional electrographic image forming apparatus forms an opening for maintenance in the housing of the image forming apparatus to facilitate removal of a sheet of paper that has jammed in the fixing device provided in an inner portion, and in addition mounts a cover on the opening. In various types of image forming apparatuses, when a user removes a printed sheet of paper by opening the cover, there is a risk of erroneously executing the printing operation relating to the user. Furthermore, there is a risk that the apparatus will malfunction due to performance of a printing operation in a state in which the cover is open. As a result, a conventional image forming apparatus includes a cover open/closed detection sensor as an interlock switch that detects whether the cover is open or closed. When the cover is open, application of current to the motor that drives the heater or the heating roller of the fixing device is suspended, and operation is stopped. In this manner, the user can be protected from contact with the heat of the heater or the heating roller, and a malfunction caused by erroneous operation of the image forming apparatus can be prevented.

In the image forming apparatus above, when the printed sheet that is jammed in the fixing device is pulled by the user in a state in which the cover is open, the heating roller is rotated by reason of the frictional force with the printed sheet that is pulled. At this time, the output shaft of the motor that supplies drive force to the heating roller is rotated and a counter electromotive force is produced by the motor. The counter electromotive force produces noise or the like in the control circuit of the control unit of the image forming apparatus. As a result, there is a risk of the occurrence of an unpredictable problem in the image forming apparatus caused by the counter electromotive force. For example, noise resulting from a counter electromotive force may have an adverse effect on the control unit with the result that a closed signal indicating that the cover is closed may be input to the control unit although the cover is not closed. In this situation, the control unit erroneously determines that the cover is closed, and executes control to drive the heater or the heating roller (hereinafter referred to as "warming-up control"). Therefore, a phenomenon is known in which the control unit makes an erroneous determination due to the effect of the noise.

Even when warming-up control is performed as a result of an erroneous determination by the control unit as described above, safety characteristics in relation to the user can be enhanced by directly cutting off power supply to the circuit that supplies a drive current to the motor or the heater by use of an electromagnetic contactor. However, when warming-up control is executed by the control unit in response to input of the closed signal, for example, a control program may be executed such as an abnormality determination program to ascertain whether or not the temperature control of the heater of the fixing device is operating normally, or an abnormality determination program that determines whether or not the heating roller is rotating normally. When the control program is executed, notwithstanding that operation is normal, a result may be output that the heater or the motor, or the temperature sensor or the rotation sensor is abnormal. In this case, since the heater or the motor is an important element in an image forming apparatus, the output of a high-level error message not only causes concern in a user of the image forming apparatus, but also since an abnormal and normal operation cannot be distinguished, the problem arises that although operation is normal, components or devices that have been determined to be abnormal must be replaced.

SUMMARY

The present disclosure includes a cover member, a cover open/closed detection sensor, a driven unit, a drive detection sensor, and an attitude determination unit. The cover member is configured to enable changing of an attitude between an open attitude in which an opening formed in a housing is open, and a closed attitude in which the opening is closed. The cover open/closed detection sensor is configured to output the closed signal corresponding to the closed attitude and an open signal corresponding to the open attitude. The driven unit is provided in an inner portion of the housing. The drive detection sensor is configured to output a state signal corresponding to a drive state of the driven unit. The attitude determination unit is configured to determine the attitude of the cover member based on a signal output from the drive detection sensor and the cover open/closed detection sensor. The attitude determination unit determines whether the cover member is in the open attitude or the closed attitude based on the state signal and the closed signal input after the open signal.

DETAILED DESCRIPTION

The embodiments of the present disclosure will be described below making suitable reference to the figures. Although the embodiments will be described in detail below, those embodiments are merely exemplary of a configuration of the present disclosure, and suitable variation may be added to each embodiment within the scope of the object of the present disclosure.

Firstly, with reference to FIG. 1, the general configuration of the image forming apparatus 10 (an example of the image forming apparatus of the present disclosure) will be described. In each of the figures, as illustrated in FIG. 1, when the image forming apparatus 10 is installed, the direction of the arrow 6 is defined as the vertical direction, the direction of the arrow 7 (the direction perpendicular to the face of the page in FIG. 1) is defined as the longitudinal direction, and the direction of the arrow 8 is defined as the transverse direction.

Figure 1:
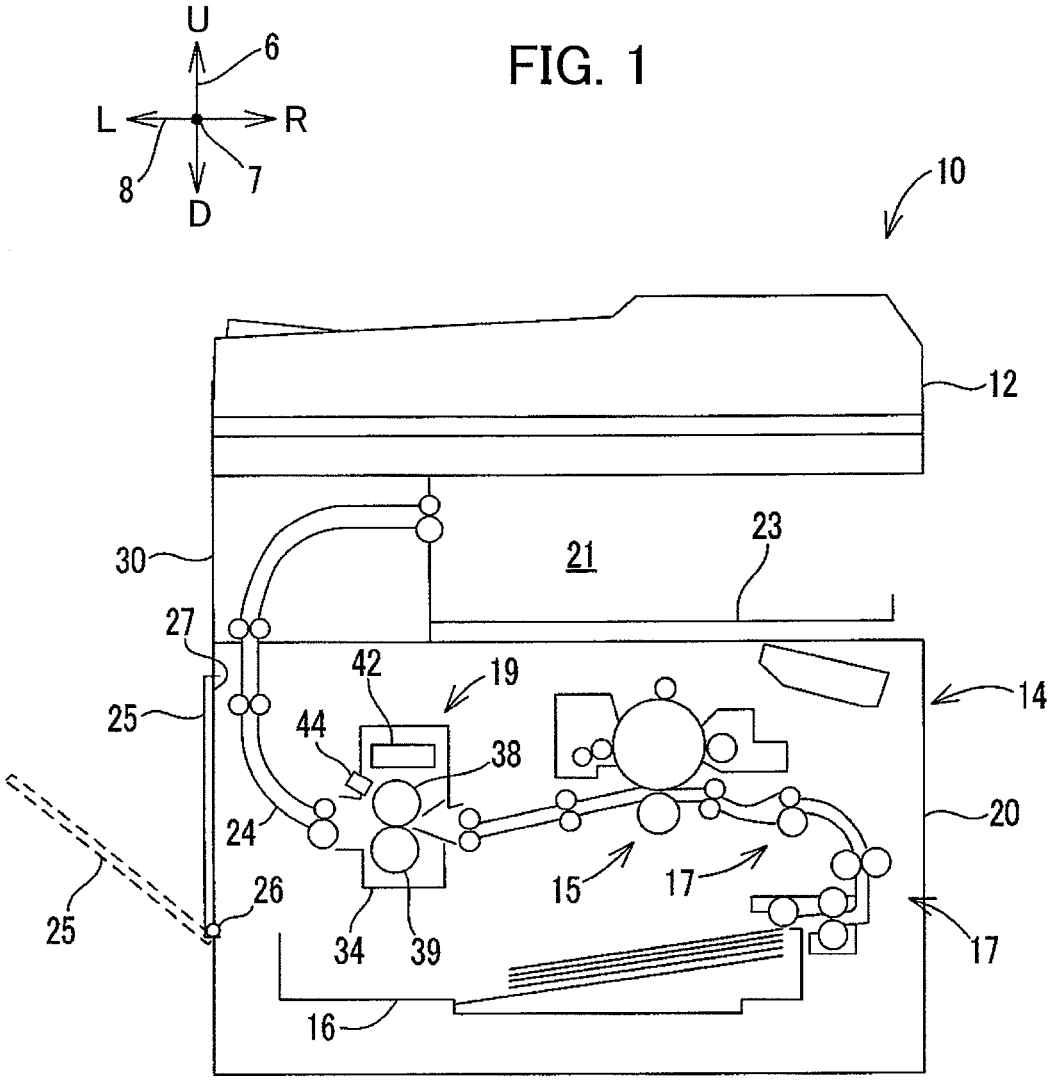
FIG. 1 is a schematic view of the general configuration of an image forming apparatus 10 according to an embodiment of the present disclosure.

As illustrated in FIG. 1, the image forming apparatus 10 is termed a so-called in-body paper discharge type, and is a multifunctional peripheral provided with respective functions such as a printer, a copying machine and a facsimile, or the like. The image forming apparatus 10 uses printing material such as toner to print an input image onto that printing paper (an example of a printing medium in the present disclosure). A scanner 12 that is configured to scan an image of an original is provided on an upper portion of the image forming apparatus 10. An electrographic image forming unit 14 is provided on a lower portion of the image forming apparatus 10. A sheet discharging unit 30 is provided on the left side of the image forming apparatus 10 in FIG. 1. The sheet discharging unit 30 forms a paper discharge space 21 between the image forming unit 14 and the scanner 12. The sheet discharging unit 30 is connected to the image forming unit 14 and the scanner 12. The image forming apparatus 10 is not limited to a multifunctional peripheral. The present disclosure can be applied to a printer, copying machine, a facsimile or the like.

An original stacking surface (not illustrated) is provided on the scanner 12. When the image forming apparatus 10 functions as a copying machine, the original is set on the original stacking surface and a copying commencement instruction is input from an operation panel (not illustrated). In this manner, a scanning operation by the scanner 12 is commenced in the image forming apparatus 10 and image data of the original is scanned.

The image forming unit 14 forms a monochrome image on the printing paper based on the image data scanned by the scanner 12. The image forming unit 14 includes a paper feed tray 16, a plurality of paper conveyance units 17, a transfer device 15, a fixing device 19, a control unit 60 to control these units/devices (refer to FIG. 2), a motor 67 (refer to FIG. 2), and a motor driver 66. The paper feed tray 16 mainly enables retaining of printing paper. The transfer device 15 transfers a toner image onto the printing paper that is conveyed from the paper feed tray 16. The fixing device 19 fixes the toner image onto the printing paper after transfer onto the printing paper. The motor 67 supplies a drive force to the fixing device 19. The motor driver 66 controls the motor 67. The constituent elements are disposed in an inner portion of a casing 20 (corresponds to the housing in the present disclosure) that configures the housing body of the image forming apparatus 14.

The paper discharge space 21 that opens in a forward direction is formed between the upper portion of the casing 20 and the scanner 12. A paper discharge tray 23 is provided in the paper discharge space 21. The printing paper that is fed from the paper feed tray 16 moves in an upward direction on a conveyance path 24, that is partitioned on the left in the casing 20. During the moving process, the toner image is transferred onto the printing paper by the transfer device 15. The toner image transferred onto the printing paper is heated and melted when passing through the fixing device 19, and is fixed to the printing paper by pressing. The printing paper that has passed through the fixing device 19 is discharged to the paper discharge space 21, and retained in the paper discharge tray 23.

As illustrated in FIG. 1, the fixing device 19 is provided on the left side on an upper portion of the casing 20. The fixing device 19 includes a heating roller 38 (an example of a driven unit and a fixing roller in the present disclosure), and a pressing roller 39. The pressing roller 39 is disposed opposite the heating roller 38. The heating roller 38 and the pressing roller 39 are supported to rotate on a frame 34. The pressing roller 39 is pressed into contact with the heating roller 38 by a spring or the like. The heating roller 38 is connected through a drive transmission mechanism (not illustrated) to the motor, 67 that is drive controlled by a motor driver 66 described below. The motor 67 is driven and rotated to transmit the rotation drive force to the heating roller 38, and the heating roller 38 rotates in a predetermined direction.

The heating roller 38 in the fixing device 19 is heated so that the surface temperature of the heating roller 38 is substantially 200 degrees C. (hereinafter referred to as "fixing temperature") to thereby melt the toner. In the present embodiment, the outer peripheral surface of the heating roller 38 is heated from one direction by use of an IH heater 42 (an example of an induction heating apparatus in the present disclosure) that uses an induction heating method and is provided on an upper portion of the heating roller 38. A temperature sensor 44 is provided on the peripheral edge of the heating roller 38 to detect the temperature of the outer peripheral surface of the heating roller 38. The detection signal from the temperature sensor 44 is input to the control unit 60.

Figure 2:
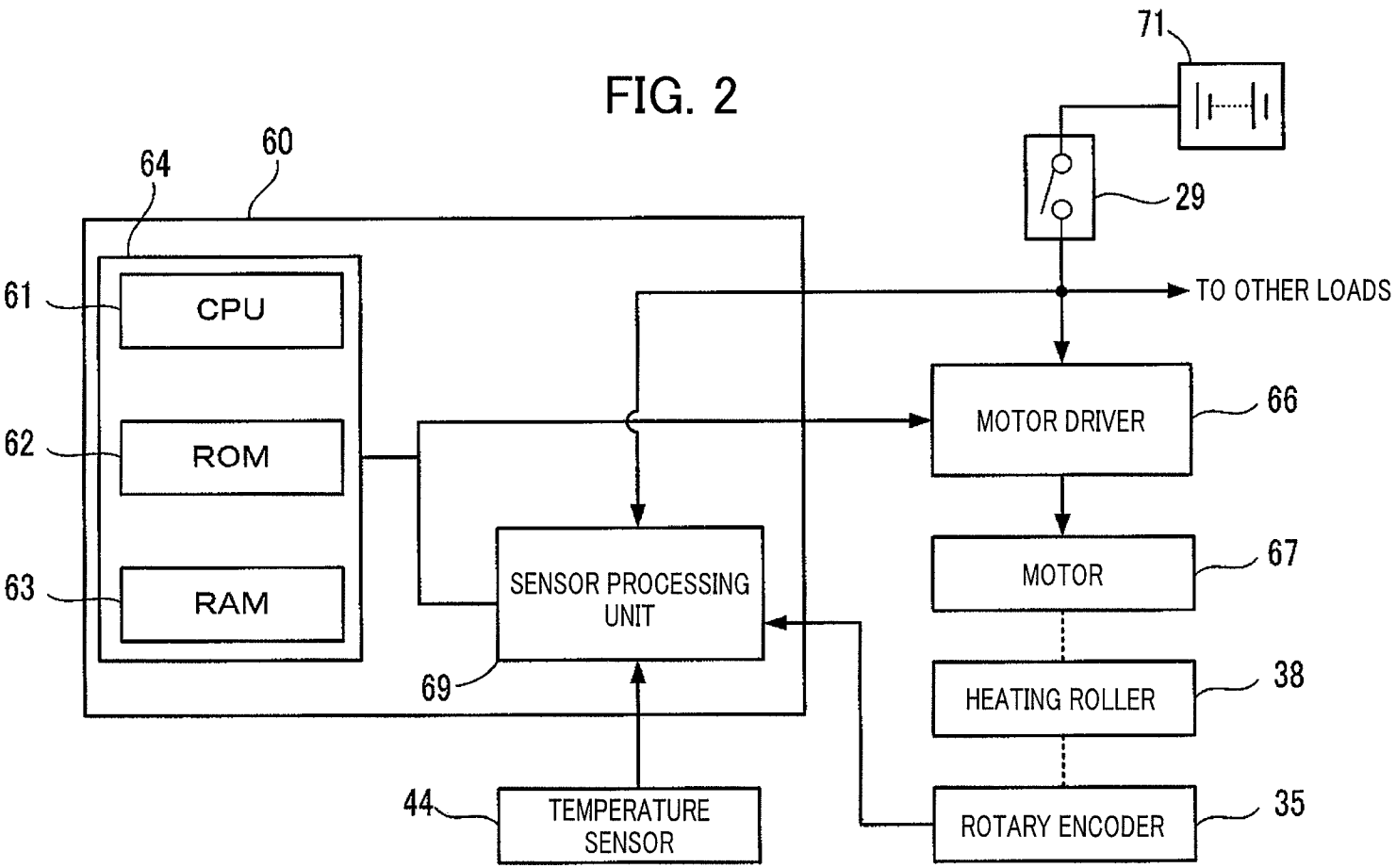
FIG. 2 is a block diagram illustrating the configuration of a control unit 60 for the image forming apparatus 10.

A rotary encoder 35 (an example of a drive detection sensor in the present disclosure, refer to FIG. 2) is provided on the rotation shaft of the heating roller 38 of the fixing device 19 to detect the rotation state of the heating roller 38. The rotary encoder 35 outputs a state signal corresponding to the rotation state of the heating roller 38 to the control unit 60. More particularly, the rotary encoder 35 outputs a rotation signal that indicates the rotation state of the heating roller 38 to the control unit 60 when the heating roller 38 is rotating. Furthermore, the rotary encoder 35 outputs a stop signal to the control unit 60 indicating the rotation state when the heating roller 38 is stopped. Various types of rotation detection sensors that output a signal indicating the rotation state of the heating roller 38 can be applied in substitution for the rotary encoder 35.

The printing paper conveyed to the fixing device 19 is gripped and conveyed by the heating roller 38 and the pressing roller 39. In this manner, a toner image formed on the printing paper is pressed while being heated. Therefore, the toner image is melted onto the printing paper. Thereafter, the printing paper is discharged to the paper discharge tray 23.

The cover 25 (an example of the cover member in the present disclosure) is provided on the left surface of the casing 20 to providing an opening to the inner portion of the casing 20. An opening 27 that communicates with the conveyance path 24 that extends from the fixing device 19 is formed on the left surface of the casing 20. The cover 25 is supported in a variable attitude between the closed attitude in which the opening 27 is closed (attitude indicated by the solid line in FIG. 1) and the open attitude that is opened (indicated by the broken line in FIG. 1). More specifically, the cover 25 is supported to rotate between a position in which the cover 25 is in the closed attitude and a position in which the cover 25 is in the open attitude by a support shaft 26 provided on a lower end of the cover 25. The opening 27 is opened and the conveyance path 24 is exposed by the rotation of the cover 25 into the opened attitude. In this manner, even when printing paper becomes jammed in a state of being gripped by the heating roller 38 and the pressing roller 39 in the fixing device 19, the printing paper can be removed from the opening 27 by pulling the printing paper from the conveyance path 24 towards the left direction.

A cover switch 29 (example of a cover open/closed detection sensor in the present disclosure) is provided in the casing 20 to detect the open/closed state of the cover 25. The cover switch 29 outputs an electrical signal in response to the open attitude of the cover 25 (hereinafter referred to as "open signal") and an electrical signal in response to the closed attitude of the cover 25 (hereinafter referred to as "closed signal"). The outputted signal is inputted to the control unit 60. The cover switch 29 may be realized by application of a mechanical sensor such as a micro switch or the like, or an optical sensor or the like.

The motor 67 supplies a rotation force to the heating roller 38. The motor 67 is configured by a brushless DC motor for example. The motor 67 is driven by the motor driver 66. A drive voltage (for example DC 24V) is supplied to the motor driver 66 from a direct current power source 71 through the cover switch 29. The motor 67 can be excited by input of the drive voltage to the motor driver 66, to thereby enable output of a rotation force that corresponds to the drive signal input from the control unit 60. In addition to the motor driver 66, another load such as a solenoid is connected through the cover switch 29 to the direct current power source 71. In the present embodiment, when the cover 25 is in the closed attitude, a projecting portion of the cover 25 (not illustrated) presses the switch portion of the cover switch 29 to thereby close the contact point of the cover switch 29. When the contact point of the cover switch 29 is closed, the drive voltage is supplied to the motor driver 66. At this time, the motor 67 can be excited by the control of the control unit 60. When the cover 25 is in the open attitude, the above contact point is opened, and the drive voltage is no longer supplied to the motor driver 66. Therefore, at this time, the motor is constantly in a non-excited state irrespective of the control performed by the control unit 60, and the motor 67 does not rotate. In this manner, the cover switch 29 not only realizes the opening and closing detection of the cover 25 but in addition to that function, also can realize a function as an interlock in the supply path of the drive voltage to the motor 67.

Next, the control unit 60 will be described. The control unit 60 performs overall control of the image forming apparatus 10. The control unit 60 as illustrated in FIG. 2 includes calculation unit 64 that is configured from a CPU 61, a ROM 62 and a RAM 63, and a sensor processing unit 69. Processing is performed in the calculation unit 64 in accordance with predetermined programs. A predetermined program is a program that is stored in the ROM 62 by the CPU 61.

In the present embodiment, a determination program is stored in the ROM 62 to realize the cover open/closed determination processing that is configured to determine the open/closed state of the cover 25. The determination program is read by the CPU 61 to thereby perform cover open/closed determination processing. The cover open/closed determination processing is a process that is executed by the control unit 60 based on the respective output signals from the cover switch 29 and the rotary encoder 35. The details will be described below. The cover open/closed determination processing is not limited to execution of a program by the CPU 61, and for example, may be realized by an electronic circuit such as an application specific integrated circuit (ASIC), or the like.

The motor driver 66 and the sensor processing unit 69 for example are configured by an internal memory or an electronic circuit such as an application specific integrated circuit (ASIC), or the like. The motor driver 66 is electrically connected to the motor 67. The motor driver 66 excites the motor 67 and controls driving based on an instruction signal from the calculation unit 64. In this manner, the heating roller 38 is rotated. The sensor processing unit 69 is electrically connected to the rotary encoder 35, the temperature sensor 44, and the cover switch 29. The sensor processing unit 69 converts the output signal that is input from the rotary encoder 35, the temperature sensor 44, and the cover switch 29 to a signal that can be processed by the calculation unit 64.

The calculation unit 64 controls the surface temperature of the heating roller 38 or determines an abnormality in the IH heater 42 based on the output signal from the temperature sensor 44 that has been converted by the sensor processing unit 69. More specifically, the calculation unit 64 controls the heating of the IH heater 42 so that the temperature of the outer peripheral surface of the heating roller 38 coincides with a fixed temperature. The control unit 60 determines an abnormal temperature in the heating roller 38 or the IH heater 42 based on whether or not the outer peripheral surface of the heating roller 38 has reached an abnormal temperature.

The calculation unit 64 determines the rotation state of the heating roller, that is to say, whether the state is rotating or the state is stopped, based on the output signal from the rotary encoder 35 that has been converted by the sensor processing unit 69. The calculation unit 64 determines that the heating roller 38 is rotating when the output signal from the rotary encoder 35 is a pulse signal (hereinafter referred to as "rotation signal"), and the calculation unit 64 determines that the heating roller 38 is stopped when the output signal from the rotary encoder 35 is a signal that expresses a fixed value (hereinafter referred to as "stop signal").

Furthermore, the calculation unit 64 determines the open/closed state of the cover 25 based on the output signal from the cover switch 29 that is converted by the sensor processing unit 69. An output signal from the cover switch 29 is a signal in which the drive voltage (DC24V) of the direct current power source 71 for example is reduced to a low voltage of 5V for example (low voltage signal) in the sensor processing unit 69. This determination is performed by execution of the cover open/closed determination process described below.

The control unit 60 controls the fixing operation or the like by the fixing device 19, the transfer operation by the transfer device 15, the conveyance operation by the conveyance unit 17 in the image forming apparatus 10. The control unit 60 shifts into power economy mode when the main power source of the image forming apparatus 10 is switched ON, or when the image forming apparatus 10 has not been used for a predetermined period. Thereafter, after returning to normal mode, or when the cover 25 is in a closed attitude after being in an open attitude in order to perform a jam processing or maintenance, the control unit 60 operates the conveyance unit 17, the transfer device 15, the IH heater 42, and the heating roller 38 to perform control to enable printing processing (warm-up control). The switching of the control mode in this manner is a conventional and known means, and detailed description thereof will be omitted herein.

Figure 3:
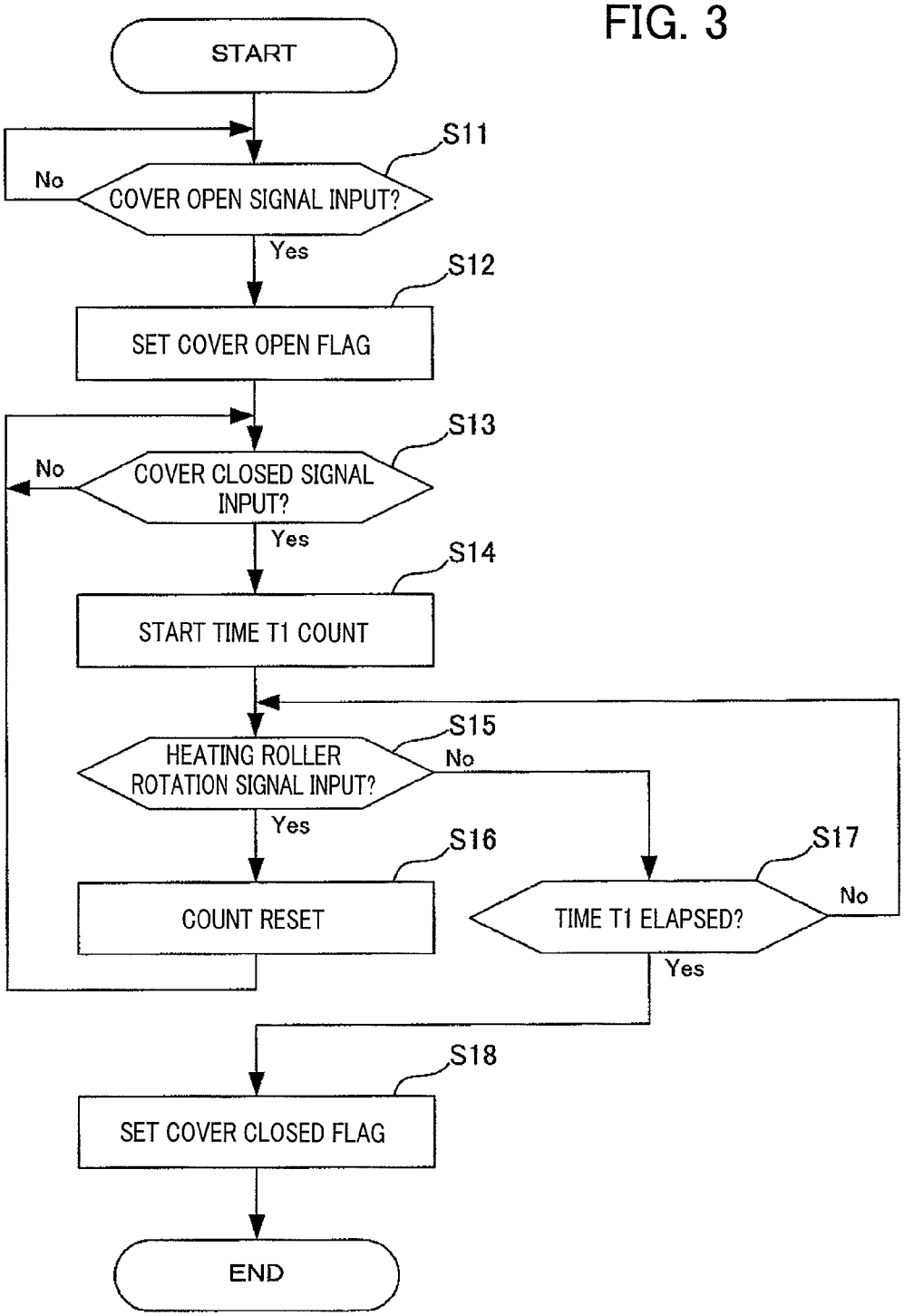
FIG. 3 is a flowchart illustrating an example of a sequence of a cover open/closed determined process executed by the control unit 60.

Next, the sequence of the cover open/closed determination processing executed by the control unit 60 will be described making reference to the flowchart in FIG. 3. The denotation S11, S12, . . . in the figure denotes the number of a processing sequence (step). The processing in each step is performed by the control unit 60, and more specifically, by execution of a program in the ROM 62 by the CPU 61 of the calculation unit 64. The attitude determination unit of the present disclosure is realized by the control unit 60.

The cover 25 of the casing 20 is opened, and when the cover 25 changes from the closed attitude to the open attitude, the open signal is output from the cover switch 29. In a step S11, the control unit 60 determines whether or not the open signal has been input. When the control unit 60 determines that the open signal has been input, in a next step S12, the flag that indicates an open cover is set in the register of the CPU 61. When the cover 25 is open, a drive voltage is not supplied to the motor driver 66, and the supply of current to the motor 67 is stopped. In the same manner, supply of current to other loads such as the IH heater 42 or the like is stopped.

Next, the control unit 60 determines whether or not the closed signal for the cover 25 is input (S13). As described above, when the cover 25 is opened, and the printing paper that is jammed in the fixing device 19 is pulled out, the heating roller 38 rotates. At this time, the output shaft of the motor 67 also rotates, and produces a counter electromotive force from the motor 67. The production of this counter electromotive force may cause unpredictable problems. More specifically, although the cover 25 is not closed, the effect of the noise resulting from the counter electromotive force may cause input of a closed signal of the cover 25 to the calculation unit 64. As a result, in the present embodiment, the control unit 60 does not perform a determination that the cover 25 has actually taken the closed attitude only on the basis of the input of the closed signal from the cover 25. The control unit 60 determines whether or not the cover 25 is actually in the closed attitude by processing in accordance with the sequence of step S14 and following steps as described below.

Next in step S14, the control unit 60 commences a count at a predetermined time $T_1$. The count of time $T_1$ is performed by a timer that is realized by hardware or software. Next, in step S15, the control unit 60 determines whether or not a rotation signal of the heating roller 38 has been input from the rotary encoder 35. When the rotation signal has been input to the control unit 60, the control unit 60 determines that the heating roller 38 is rotating, and the processing proceeds to step S16. On the other hand, when the rotation signal has not been input, and a stop signal has been input to the control unit 60, the control unit 60 determines that the heating roller 38 is stopped, and the processing proceeds to step S17.

In step S15, when the rotation signal is input to the control unit 60, and the control unit 60 determines that the heating roller 38 is rotating, there is a high possibility that the cover 25 is not closed, and a sheet of printing paper that has jammed in the fixing device 19 is being pulled out, and the heating roller 38 is rotated by a force other than the motor 67. As a result, in this situation, the control unit 60 determines that the cover 25 is in the open attitude even when the closed signal for the cover 25 is inputted. Next in step S16, the control unit 60 resets the count value for the time $T_1$, and thereafter, the processing returns to step S13, and repeats the processing of step S13 and, following steps.

In step S15, when a rotation signal is not inputted to the control unit 60, and the control unit 60 determines that the heating roller 38 is stopped, since the heating roller 38 is not rotating, the reliability of the closed signal for the cover 25 is high. As a result in this situation, since the closed signal for the cover 25 is input to the control unit 60, the control unit 60 determines that the cover 25 is in the closed attitude. Next in step S17, to further enhance reliability, the control unit 60 determines whether or not the time $T_1$ has elapsed. The determination by the control unit 60 in step S17 of whether or not time $T_1$ has elapsed enables a determination of whether or not the closed signal has been inputted during the continuous period of time $T_1$. When the time $T_1$ has not elapsed, the processing returns to step S15, and the control unit 60 repeats the processing of step S15 and following steps. On the other hand, when the time $T_1$ has elapsed, the control unit 60 determines that the cover 25 is in the closed attitude, and the control unit 60 in the following step S18 sets the flag that indicates a closed cover in the register of the CPU 61.

Since the image forming apparatus 10 in the present embodiment has a configuration as described above, in addition to the closed signal for the cover switch 29 that acts as a cover open/closed detection sensor, a state signal that indicates the driving state of the heating roller 38 that acts as a driven unit (rotation signal, stop signal) is used as a determination element in the attitude determination process by the control unit 60 that acts as a determination unit. As a result, the control unit 60 can execute an accurate determination of whether the cover 25 is in the open attitude or in the closed attitude. In this manner, the control unit 60 does not make an erroneous determination due to an error in relation to the closed attitude when the cover 25 is in the open attitude. Therefore the control unit 60 does not execute program(s) or the like for the determination of an abnormality as described above, or warming-up control as described above due to an error when the cover 25 is in the open attitude.

The control unit 60 determines that the cover 25 is in the above closed attitude when the closed signal has been input, and after a continuous fixed time $T_1$, the stop signal is input. Therefore, the control unit 60 can more accurately determine the attitude of the cover 25.

Furthermore, even when it is unclear whether the closed signal indicates that the cover 25 that is the cover member is actually closed, or when the signal is produced as a result of noise, the type of state signal that is input (the drive signal and the stop signal) enables determination of the closed attitude and the open attitude of the cover 25. In this manner, it is possible to accurately determine whether the cover 25 is in the open attitude or in the closed attitude.

When the fixing roller is heated by an induction heating device, the surface of the fixing roller is heated from one direction. In this situation, heating is performed while rotating the fixing roller in order to uniformly heat the surface of the fixing roller. If it is assumed that the fixing roller is heated when operation is stopped, the surface of the fixing roller will be excessively heated, and the heated portion will melt, deform, or undergo deterioration. In the present disclosure, the use of the drive signal or the stop signal from a drive detection sensor enables realization of the attitude determination unit in the absence of the provision of a new sensor.

More specifically, in a configuration in which the heating roller 38 is heated by an IH heater 42, control is performed so that the heating by the IH heater 42 is commenced when the heating roller 38 is actually rolling in order to prevent melting, deformation, or deterioration of the heating roller 38. In this configuration, the rotary encoder 35 is provided to detect the rotation of the heating roller 38. In the above embodiment, the use of the drive signal and the stop signal from an existing rotary encoder 35 executes the attitude determination processing. As a result, there is no requirement to provide a new sensor as a drive detection sensor in the present disclosure.

The invention claimed is:

1. An image forming apparatus comprising a cover member configured to enable changing of an attitude between an open attitude in which an opening formed in a housing is open, and a closed attitude in which the opening is closed, a cover open/closed detection sensor configured to output a closed signal corresponding to the closed attitude and an open signal corresponding to the open attitude, a driven unit provided in an inner portion of the housing, a drive detection sensor configured to output a state signal corresponding to a drive state of the driven unit, and an attitude determination unit configured to determine the attitude of the cover member based on a signal output from the drive detection sensor and the cover open/closed detection sensor, wherein the attitude determination unit determines whether the cover member is in the open attitude or the closed attitude based on the state signal and the closed signal input after the open signal, and when a drive signal is input after the input of the closed signal, the drive signal indicating that the driven unit is being driven, the attitude determination unit determines that the cover member is in the open attitude, and when a stop signal is input after the input of the closed signal, the stop signal indicating that the driven unit is stopped, the attitude determination unit determines that the cover member is in the closed attitude.

2. The image forming apparatus according to claim 1, wherein the driven unit is a fixing roller configured to melt and attach a toner image to a printing medium by pressing during application of heat to the toner image formed on the printing medium, and the drive signal is a signal that indicates that the fixing roller is rotating, and the stop signal is a signal that indicates that the fixing roller is stopped.

3. The image forming apparatus according to claim 2, wherein the driven unit is a fixing roller configured to heat an outer periphery surface by use of an induction heating apparatus, and to melt and attach the toner image to the printing medium by pressing during application of heat to the toner image formed on the printing medium.

4. The image forming apparatus according to claim 2, wherein the drive detection sensor is a rotary encoder configured to detect a rotation state of the fixing roller.

5. The image forming apparatus according to claim 2, wherein the cover member is opened and closed when a printing medium that has jammed in the fixing roller is removed.

6. The image forming apparatus according to claim 1, wherein the cover open/closed detection sensor is an interlock switch.

7. The image forming apparatus according to claim 1, wherein the attitude determination unit determines that the cover member is in the closed attitude when the stop signal is continuously input for a predetermined period of time after the input of the closed signal.

* * * * *